US006581328B2

(12) United States Patent
LaMear

(10) Patent No.: US 6,581,328 B2
(45) Date of Patent: Jun. 24, 2003

(54) FLOWERS SUPPORT SYSTEM AND APPARATUS

(76) Inventor: Phillip LaMear, 939 Northeast Boat St., Seattle, WA (US) 98105

( * ) Notice: Subject to any disclaimer, the term of this patent is extended or adjusted under 35 U.S.C. 154(b) by 0 days.

(21) Appl. No.: 09/834,275

(22) Filed: Apr. 12, 2001

(65) Prior Publication Data

US 2001/0042342 A1 Nov. 22, 2001

Related U.S. Application Data

(60) Provisional application No. 60/196,680, filed on Apr. 12, 2000.

(51) Int. Cl.[7] ..... A01G 9/02

(52) U.S. Cl. ..... 47/66.1; 47/41.01; 47/65.7; 206/423; 206/499; 220/23.87

(58) Field of Search ..... 47/29.3, 66.1, 47/69, 75, 41.01, 65.5, 65.7, 68; D11/143, 145, 155, 164; D9/456; 119/253, 269; 206/423, 499; 220/23.87, 630, 611, 668; 40/649; 428/34.1

(56) References Cited

U.S. PATENT DOCUMENTS

| | | | | | |
|---|---|---|---|---|---|
| 1,087,546 | A | | 2/1914 | Nies | |
| D48,108 | S | * | 11/1915 | Halterbeck | D30/101 |
| 1,856,179 | A | | 5/1932 | Wells | |
| 3,244,145 | A | * | 4/1966 | Braunhut | 119/269 |
| D236,633 | S | * | 9/1975 | Shalom | D30/101 |
| 4,014,506 | A | | 3/1977 | Hanson | |
| 4,047,633 | A | * | 9/1977 | Trombly | 220/592.2 |
| 4,428,168 | A | * | 1/1984 | Tomer | 52/104 |
| 4,525,950 | A | * | 7/1985 | Glassman | 47/41.01 |
| 4,936,046 | A | * | 6/1990 | Miller | 47/41.01 |
| 5,073,115 | A | * | 12/1991 | Howell | 434/297 |
| 5,207,019 | A | * | 5/1993 | Massey et al. | 47/41.01 |
| 5,218,774 | A | * | 6/1993 | Mullins | 40/722 |
| 5,236,102 | A | * | 8/1993 | Quittmann et al. | 220/23.87 |
| 5,363,592 | A | | 11/1994 | Weder et al. | |
| 5,628,164 | A | | 5/1997 | Weder et al. | |
| 5,706,605 | A | | 1/1998 | Alcazar et al. | |
| D397,523 | S | * | 8/1998 | Ray | D30/108 |
| 5,870,857 | A | * | 2/1999 | Yerich | 47/87 |
| 5,899,037 | A | * | 5/1999 | Josey | 52/267 |
| 6,220,507 | B1 | * | 4/2001 | Guillin | 229/122.22 |

FOREIGN PATENT DOCUMENTS

JP 10262794 A * 10/1998

* cited by examiner

*Primary Examiner*—Charles T. Jordan
*Assistant Examiner*—Tara M Golba
(74) *Attorney, Agent, or Firm*—Robert B. Hughes; Hughes Law Firm, PLLC

(57) ABSTRACT

A two piece vase adapted to house flowers or a floral arrangement. An insert is adapted to be mounted in a chamber of a vase structure. The insert is not readily visible when inserted into the vase structure and provides a water-tight seal. The insert is further easier to clean and provides a more convenient method of mounting the flowers into the vase.

17 Claims, 2 Drawing Sheets

FLOWERS SUPPORT SYSTEM AND APPARATUS

RELATED APPLICATIONS

This application claims priority of U.S. Provisional Application Ser. No. 60/196,680 filed Apr. 12, 2000.

BACKGROUND OF THE INVENTION

1. Field of the Invention

The invention relates to vases and devices to display flowers or the like.

Vases or other devices adapted to hold flowers traditionally have sufficient open areas that allow the interior portion to be cleaned by hand. However, with vases having a narrow dimension portion the opening to the interior chamber does not allow easy access to the chamber region for cleaning. Further, when a vase is comprised from heterogeneous materials it is not readily feasible to provide a watertight vase.

Therefore, it is advantageous to have a heterogeneous vase that provides an aesthetically pleasing appearance while providing a waterproof chamber. To maintain a waterproof chamber brings forth numerous challenges with discrete components and especially when the components are of different materials.

The applicant has experimented with sealing the first chamber of the vase using caulking materials and other transparent adhesives; however, the applicant could not provide satisfactory results. Namely, any caulking material or glue would diminish the visible characteristics around the perimeter of the first and second transverse visible portions. Further, given the different characteristics of glass and a stone type material such as marble, it was extremely difficult to provide a first chamber that could hold water even at low head static pressure. Finally, trying to seal the first chamber did not remedy the problems with cleaning the vase.

Therefore, the applicant remedied these problems by retrieving a transparent insert having an upper end that is open and provides access to a second chamber that is watertight. The insert can be placed in the first chamber and is nearly unnoticeable when in an operating position (i.e. with flowers and fluid contained therein).

The insert is much less expensive than the remainder of the vase and in the preferred form is made from a unitary transparent plastic structure. The insert can be machine or hand washed or can be easily replaced. Further, the insert allows the stem portions of the flowers or floral arrangements to be inserted therein and water poured into the chamber of the insert (referred to as the second chamber) and then the insert can be placed into the first chamber of the vase structure.

2. Background Art

A search of the patent literature produced the following applications.

U.S. Pat. No. 5,628,164 & U.S. Pat. No. 5,363,592 Weder et al, shows a flower container and various aspects of a water proof cover.

U.S. Pat. No. 4,525,950 Glassman, shows a receptacle in which an inner container 10, is surrounded by an outer container. The containers are both fluid tight and fluid may be placed in one or in both. The inner container is adapted to hold dried flowers, while the outer volume contains a decorative fluid.

U.S. Pat. No. 4,014,506 Hanson, shows a system in which a smaller flower pot is suspended in a larger container.

U.S. Pat. No. 1,856,179 Wells, shows an ornamental outer container used to house a flower pot containing a plant.

U.S. Pat. No. 1,087,546 Nies, shows a plant container formed of wood, with an outer layer of bark provided with a metal insert for containing a plant.

SUMMARY OF THE INVENTION

The invention comprises a frame and an insert. The frame consists of at least one transparent portion and has an upper opening that provides access to an inner chamber. The insert has a chamber portion and an upper opening and is adapted to fit within the said chamber of the frame. The insert has a transparent portion that corresponds to the position transparent portion of the frame. The insert is waterproof and adapted to receive flowers and water therein. Further, the insert is replaceable at a lower cost than the frame.

DETAILED DESCRIPTION OF PREFERRED EMBODIMENTS OF THE PRESENT INVENTION

An axis system 10 is defined where the axis 12 indicates a lateral direction, the axis 14 indicates a transverse direction and the axis 16 indicates a vertical direction.

Figure 1:
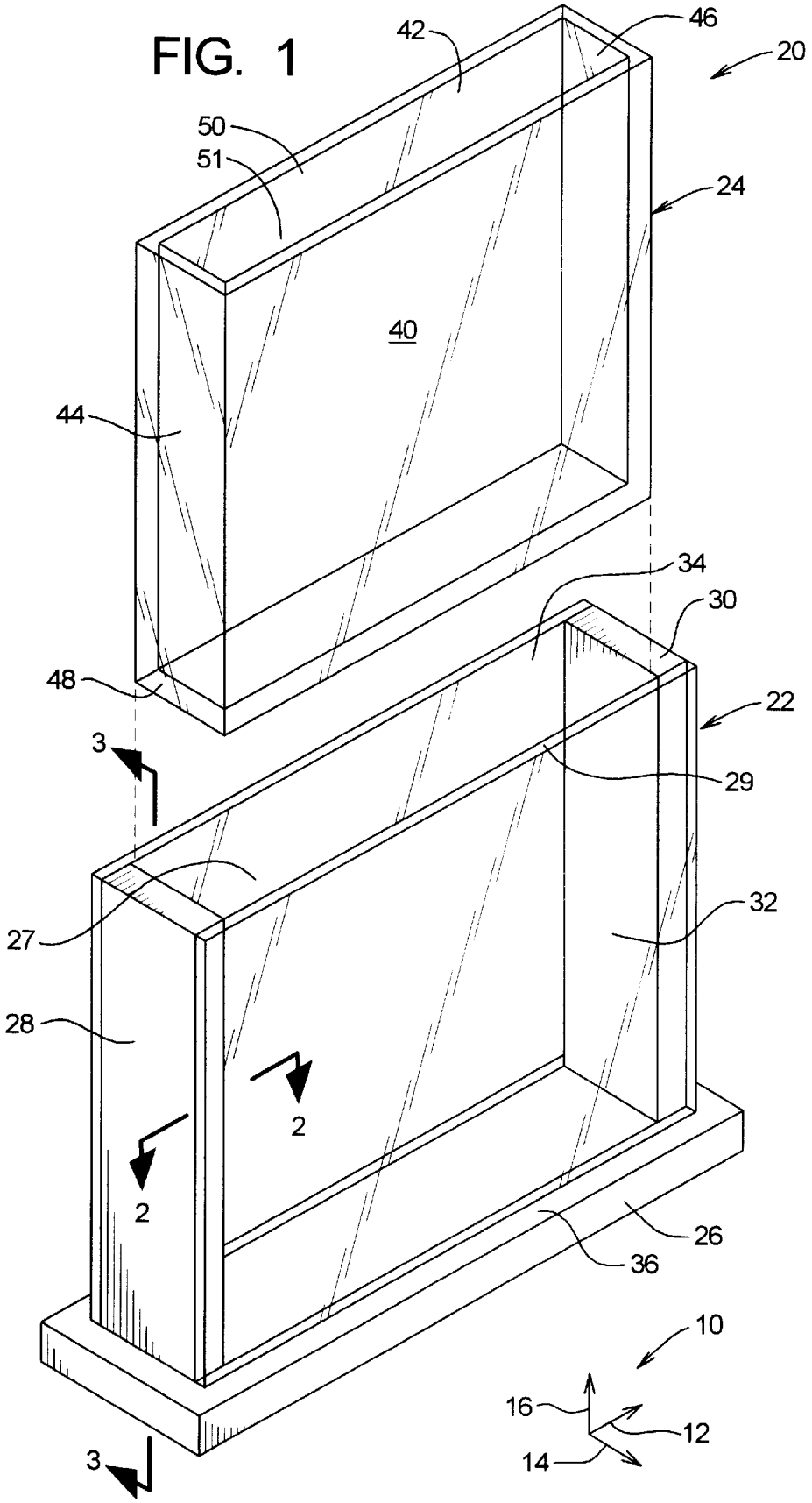
FIG. 1 is a perspective view exploded where the insert is shown above the vase structure.

As shown in FIG. 1, the apparatus 20 comprises a frame 22 and a transparent insert 24. The frame 22 comprises a base portion 26, substantially vertical members 28 and 30, and first and second transparent members 32 and 34. The base portion 26 and the members 28 and 30 are preferably made from a rigid material such as marble or other materials. Such materials include but are not limited to stone type materials, mineral materials, nontransparent marble like stone. It is desirable to have a material with an aesthetically pleasing finish. The base platform 26 has an upper surface 36 that provides support for the members 28 and 30. The members 28 and 30 are substantially vertical and attached to the transparent portions 32 and 34. The material used for the transparent members 32 and 34 is preferably glass; however, other transparent mediums could be used. The inner surface of the transparent members 32 and 34, and the inner surface of the vertical supports 28 and 30 as well as the upper surface of the base 26 define a chamber 27. In the upper portion of the frame 22 there is located the upper opening portion 29.

It should be noted that glass and marble have different thermal coefficients of expansion. This creates a problem for attaching the vertical members 28 and 30 to the glass portions 32 and 34. Of course, the apparatus 20 must be aesthetically pleasing to the end consumer.

The inventor has experimented with numerous glues and adhesives to try to find a working combination to create a sealed vase that can hold water. Due to the different physical properties of glass and marble it was difficult to find an adhesive with adequate results. The glue would either fail in time, due to moisture and/or sunlight, or excessive caulking was required at the contact portions. The excessive amount of adhesive at the contact portions ruined the aesthetics of the vase 20.

The inventor therefore resorted to using double-coated acrylic foam tapes and adhesives transfer tapes. The specific brand used by the inventor is VHB™ (Very High Bond) produced by 3M™ Specialty Tapes & Adhesives. This product discreetly attached the transparent portions 32 and 34 to the vertical members 28 and 30.

However, the problem of having the vases 20 seal water still remained. Further, cleaning the vase was impossible due to the narrow gap between the transparent members 32 and 34.

Figure 2:
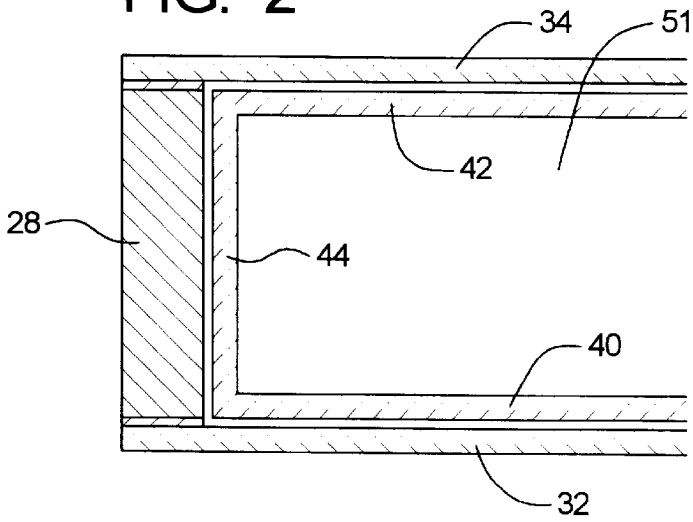
FIG. 2 is a vertical cross-sectional view taken at line 2—2 of FIG. 1 looking down one of the sides of the vase structure with the insert contained therein.
Figure 3:
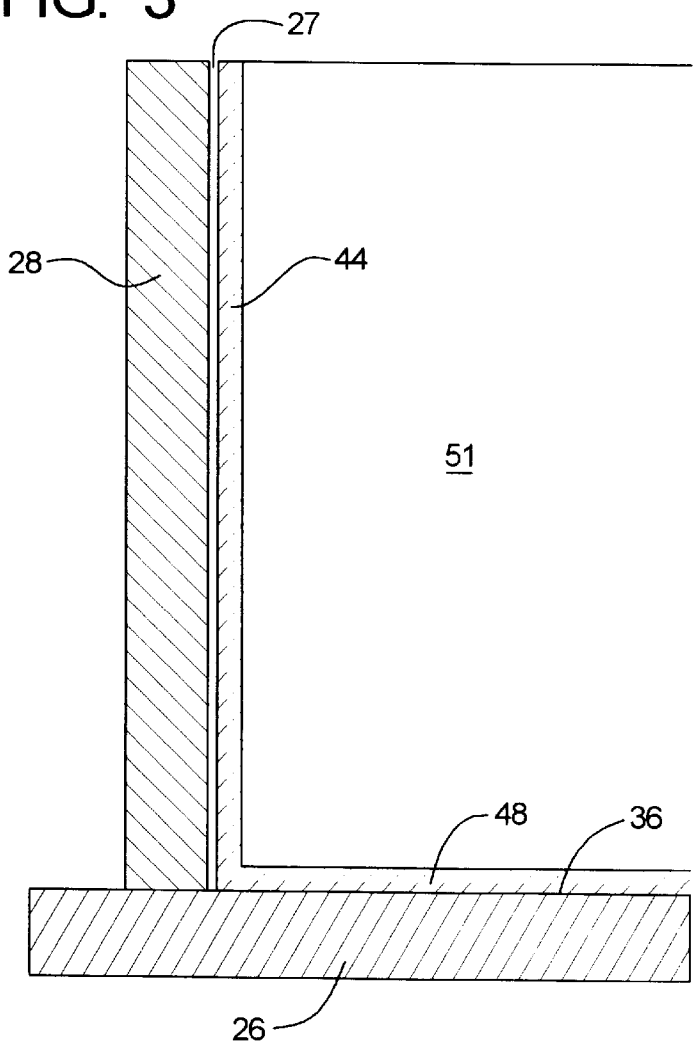
FIG. 3 is a vertical partial cross-sectional view taken at line 3—3 of FIG. 1 showing a section of the insert and the vase structure.

The inventor therefore developed the insert 24. The insert 24 comprises a first transparent wall 40, a second transparent wall 42, side transparent walls 44 and 46, and bottom transparent wall 48. The upper portion of walls 40, 42, 44, and 46, define an opening 50 that provides communication to second chamber 51. In operation water is poured into the opening 50 and flowers are inserted therein (see FIG. 3). Then as seen in FIG. 1, the lower wall 40 is inserted into the opening 29 of the frame member 22. Shown in FIG. 2, the insert is nearly all the way placed in the chamber 27. When the insert is fully inserted the lower surface of the bottom wall 48 is resting upon the upper surface 36 of the base portion 26 (see FIG. 3).

It should be noted that the insert 24 could be plastic injection molded. It should further be noted that the insert 24 is generally less expensive to produce than the frame 22. Therefore, if the insert 24 becomes very dirty (from mildew for example) and impossible to clean, the owner of the apparatus 20 can order a new insert 24.

As shown in the figures, the ratio between the lateral width and the transverse width of the first chamber in the preferred form has a ratio that is greater in the lateral direction then the transverse direction. A broad range for this dimension is 1—1 and providing a square horizontal cross-sectional opening. A more preferred range is 3–1 where the lateral width is at least three times greater than the transverse width and other ranges include at least 5–1 and 8–1. In the preferred form the height of the apparatus 20 is greater in dimension than the horizontal or transverse dimensions shown in FIG. 1.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. A vase assembly for housing and displaying floral and plant arrangements, said vase assembly comprising:

a) an outer containing structure having a base member, transparent outer side walls extending upwardly from said base member, and non-transparent outer end walls extending upwardly from said base member, and, made of an end wall material which is dissimilar to a side wall material from which the side walls are made, said side walls, said end walls, and said base being connected to one another and forming a first outer chamber with a first top access opening;

b) said assembly having a lateral axis extending horizontally between said end walls, a transverse axis extending between said side walls, and a vertical axis;

c) an insert which is removably positioned in said first chamber and which is comprised of an integral, watertight, and transparent plastic material having inner side walls, inner end walls, and a bottom wall, and which form a second inner chamber with a second top access opening;

d) each of said first and second chambers having vertical and lateral dimensions substantially greater the transverse dimension;

e) said inner side walls having lateral and vertical dimensions only moderately smaller than corresponding lateral and vertical dimensions of said outer side walls, so that said second chamber has an overall configuration and dimension, relative to a view looking toward one of the outer side walls, similar to the first chamber, f) said vase assembly being characterized in that with said insert being positioned in said outer containing structure, said inner end walls are closely adjacent to said outer end walls, said inner side walls are closely adjacent to said outer side walls, and upper perimeter portions of said insert and said outer containing structures are at approximately the same height, so that vase assembly has an overall appearance of an unitary structure having two single transparent side walls and two single end walls of a material different from the side walls;

g) whereby, with the insert being positioned in the first chamber, upper end portions of the inner side walls are adjacent to upper end portion of the outer side walls for easy removal and replacing of the insert, and with floral arrangements being positioned in the second chamber, there is the appearance of the flowers being positioned in a chamber having a containing area having width and height commensurate with a containing area of the first chamber.

2. The assembly as recited in claim 1, wherein said outer side walls are composed of a substantially rigid, transparent material.

3. The assembly as recited in claim 2, wherein the substantially rigid, transparent material comprises glass.

4. The assembly as recited in claim 1, wherein said outer end walls are composed of a substantially rigid, non transparent material.

5. The assembly as claim 4, wherein the substantially rigid, non-transparent material comprises stone.

6. The assembly as recited in claim 1 wherein the outer end walls, outer side walls, and base of outer containing structure are connected by a clear, double sided, closed-cell, acrylic, adhesive tape.

7. The assembly as recited in claim 6 wherein, the clear, double-sided, closed-cell, acrylic, adhesive tape is no greater than about 1 mm in thickness.

8. The assembly as recited in claim 6 wherein, the clear, double-sided, closed-cell, acrylic, adhesive tape has a width no greater than about one quarter of an inch.

9. The assembly as recited in claim 1, wherein the inner and outer chambers have a vertical dimension that is greater than either the horizontal or transverse dimensions.

10. The assembly as recited in claim 1, wherein the inner and outer chambers are arranged so that the lateral to transverse dimensional ratio of the inner chamber, is at least or greater than 3 to 1.

11. The assembly as recited in claim 10, wherein the lateral to transverse dimensional ratio of the inner chamber is at least 5 to 1 or greater.

12. The assembly as recited in claim 1, wherein said insert is disposable.

13. The assembly as recited in claim 1 wherein said side walls of the outer containing structure and the insert are planar.

14. The assembly as recited in claim 13, wherein said side walls of the outer containing structure and the insert are substantially rectangular.

15. A method of displaying a plant or plant like product, comprising:

a) providing an outer containing structure having a base member, transparent outer side walls extending upwardly from said base member, and non-transparent outer end walls extending upwardly from said base member, which are made of an end wall material which is dissimilar to a side wall material from which the side walls are made; said side walls, said end walls, and said base being connected to one another and forming a first outer chamber with a first top access opening; said outer containing structure having a lateral axis extending horizontally between said end walls, a transverse axis extending between said side walls, and a vertical axis;

b) providing an insert which is comprised of an integral, watertight, and transparent material having inner side walls, inner end walls, and a bottom wall, and which form a second chamber with a second top access opening; said method being characterized in that:

i) each of said inner and outer chambers have vertical and lateral dimensions substantially greater than the transverse dimension;

ii) said inner side walls have lateral and vertical dimensions only moderately smaller than corresponding lateral and vertical dimensions of said outer side walls, so that said second chamber has an overall configuration and dimension, relative to a view looking toward one of the outer side walls, similar to the first chamber;

c) positioning the insert in the first chamber, with upper end portions of the inner side walls are approximately adjacent to upper end portion of the outer side walls for easy removal and replacing of insert;

d) placing said plant or plant like product in the second chamber, so that there is the appearance of the products positioned in a chamber having a containing area having width and height commensurate with a containing area of the first chamber.

16. A vase assembly for housing and displaying floral and plant arrangements, said vase assembly comprising:

a) an outer containing structure having a base member, transparent, generally rectangular and planar outer side walls extending upwardly from said base member, and non-transparent outer end walls having a generally planar configuration and extending upwardly from said base member, and, made of an end wall material which is dissimilar to a side wall material from which the side walls are made, said side walls, said end walls, and said base being connected to one another and forming a first outer generally rectangular chamber with a first top access opening;

b) said assembly having a lateral axis extending horizontally between said end walls, a transverse axis extending between said side walls, and a vertical axis;

c) an insert which is removably positioned in said first chamber and which is comprised of an integral, watertight, and transparent plastic material having inner generally rectangular and planar side walls, inner generally rectangular and planar end walls, and a bottom wall, and which form a second generally rectangular inner chamber with a second top access opening;

d) each of said first and second chambers having vertical and lateral dimensions substantially greater than the transverse dimension;

e) said vase assembly being characterized in that with said insert being positioned in said outer containing structure, said inner end walls are closely adjacent to said outer end walls, said inner side walls are closely adjacent to said outer side walls, and upper perimeter portions of said insert and said outer containing structures are at approximately the same height, so that vase assembly has an overall appearance of an unitary structure having two single transparent side walls and two single end walls of a material different from the side walls, and the second inner chamber has the appearance of having a containing area commensurate with a containing area of the first chamber;

f) whereby, with the insert being positioned in the first chamber, upper end portions of the inner side walls are adjacent to upper end portion of the outer side walls for easy removal and replacing of the insert, and with floral arrangements being positioned in the second chamber, there is the appearance of the flowers being positioned in a chamber having a containing area having width and height commensurate with a containing area of the first chamber.

17. The vase assembly as recited in claim 16, wherein said second inner chamber has vertical and lateral dimensions at least five times greater than the transverse dimension.

* * * * *